US005628129A

United States Patent [19]

Kilgore et al.

[11] Patent Number: 5,628,129

[45] Date of Patent: May 13, 1997

[54] SHOE SOLE HAVING DETACHABLE TRACTION MEMBERS

[75] Inventors: Bruce J. Kilgore, Lake Oswego; William M. Dieter, Portland, both of Oreg.

[73] Assignee: Nike, Inc., Beaverton, Oreg.

[21] Appl. No.: 466,742

[22] Filed: Jun. 6, 1995

[51] Int. Cl.[6] ..... A43B 5/00; A43C 15/00

[52] U.S. Cl. ..... 36/134; 36/67 D; 36/126

[58] Field of Search ..... 36/67 D, 67 R, 36/66, 134, 61, 62, 126, 127, 128, 129

[56] References Cited

U.S. PATENT DOCUMENTS

| | | | |
|---|---|---|---|
| 1,797,668 | 3/1931 | Morisse | 36/134 X |
| 2,506,801 | 5/1950 | MacNeill | 36/67 D |
| 2,844,833 | 7/1958 | Odermatt . | |
| 3,040,450 | 6/1962 | Phillips | 36/134 X |
| 3,267,593 | 8/1966 | Turner | 36/67 D |
| 3,410,005 | 11/1968 | Szerenyi . | |
| 3,816,945 | 6/1974 | Egtvedt | 36/32 R X |
| 3,911,600 | 10/1975 | Dassler | 36/67 D |
| 3,928,881 | 12/1975 | Bente | 36/67 D X |
| 4,178,702 | 12/1979 | Mayer | 36/59 R |
| 4,299,038 | 11/1981 | Epple | 36/67 D |
| 4,366,632 | 1/1983 | Bente | 36/67 D |
| 4,392,312 | 7/1983 | Crowley et al. | 36/67 R |
| 4,414,763 | 11/1983 | Bente | 36/134 |
| 4,445,288 | 5/1984 | Frör | 36/134 |
| 4,470,207 | 9/1984 | Bente | 36/134 |
| 4,492,047 | 1/1985 | Arff | 36/134 |
| 4,561,197 | 12/1985 | Misevich | 36/127 |
| 4,633,600 | 1/1987 | Dassler et al. | 36/134 |
| 4,644,672 | 2/1987 | Dassler et al. | 36/134 |
| 4,648,187 | 3/1987 | Dassler et al. | 36/134 |
| 4,698,923 | 10/1987 | Arff | 36/128 |
| 4,698,924 | 10/1987 | Greiner et al. | 36/134 |
| 4,712,318 | 12/1987 | Greiner et al. | 36/134 |
| 4,771,555 | 9/1988 | Ohashi | 36/3 R |
| 4,833,796 | 5/1989 | Flemming | 36/134 |
| 5,123,184 | 6/1992 | Ferreira | 36/134 |
| 5,243,775 | 9/1993 | Swain | 36/134 |
| 5,363,573 | 11/1994 | Kilgore et al. | 36/131 |

FOREIGN PATENT DOCUMENTS

| | | | |
|---|---|---|---|
| 0360202 | 3/1990 | European Pat. Off. | 36/134 |
| 0377911 | 7/1990 | European Pat. Off. | 36/134 |
| 3134817 | 3/1983 | Germany | 36/134 |

OTHER PUBLICATIONS

Photos of prior art Converse cleat outsole.
Photos of prior art Adidas cleat outsole.
Photo of prior art Pony cleat member.

*Primary Examiner*—B. Dayoan
*Attorney, Agent, or Firm*—Banner & Witcoff, Ltd.

[57] ABSTRACT

A sole for an athletic shoe includes a sole plate and a plurality of openings that extend through the sole plate. A receptacle insert is embedded within the sole plate at each opening location and an inner sidewall of each receptacle insert defines a receiving opening for a cleat element. Each receiving opening has a plurality of engagement notches disposed around the periphery thereof. A plurality of detachable cleat elements including a base member and a traction member are also provided. The base member of the cleat element has a plurality of engagement projections extending outward from its periphery. For attachment, each cleat element is positioned in one of the receiving openings such that the engagement projections are aligned with the engagement notches. Rotation of the cleat element then detachably secures the cleat element within the receptacle insert of the sole plate.

15 Claims, 6 Drawing Sheets

SHOE SOLE HAVING DETACHABLE TRACTION MEMBERS

TECHNICAL FIELD

The present invention relates to a shoe sole for an article of footwear, and more particularly, to a shoe sole having detachable traction members, cleats or lugs for improving the performance of the article of footwear on natural and manmade surfaces and for extending the service life of the article of footwear.

BACKGROUND OF THE INVENTION

Depending upon the sport, a variety of traction members, cleats and lugs are used in different orientations in order to improve the traction afforded by the athletic shoe. For example, metal or plastic cleats are often used for baseball and football footwear and metal spikes are generally preferred for running and soccer footwear. The cleats or the like can be integrally formed with the sole of the shoe or, alternatively, the cleats can be replaceable. When using replaceable cleats, the service life of the shoe is extended because a damaged or worn cleat can merely be replaced rather than having to discard the entire shoe. Replaceable cleats generally have a threaded screw attachment element and a similar threaded receptacle is provided in the sole of the shoe. However, the placement of a threaded receptacle in the sole plate increases the thickness and the weight of the athletic shoe, as well as the manufacturing costs. Replaceable cleats also have a tendency to become dislodged during use and often require special tools or a screwdriver for removal, thus detracting from their initial appeal.

For example, U.S. Pat. No. 4,712,318 to Greiner et al. discloses a gripping element having a metal shank portion with a male screw thread thereon for fixing the gripping element to the sole of a sports shoe. Thus, the thickness of the sole must be increased to accommodate the screw thread connection.

U.S. Pat. No. 4,299,038 to Epple discloses an outer sole equipped with replaceable synthetic insert elements adapted to be threadedly secured in overlapping relationship to raised projections on the sole exterior. The insert elements are adapted to receive and retain conventional spikes or the insert elements can include integrally formed gripping projections. The threaded sole openings which receive the insert elements again require an increased sole thickness in order to assure a secure connection therebetween. In addition, a special tool or the metal spike itself must be used to attach the insert element to the threaded sole opening.

U.S. Pat. No. 3,911,600 to Dassler further provides an exchangeable gripper element having a steep thread in the form of one or more helical ribs or grooves, and a locking element in the form of a projection or recess disposed on the threaded extension. Thus, the gripping element is secured against undesired loosening in use. However, the increased sole thickness is still mandated by the prior art screw thread connection.

SUMMARY OF THE INVENTION

The present invention overcomes the disadvantages of the prior art by providing a detachable cleat that securely locks into position without the use of a threaded screw attachment and which does not require any special tools for attachment or removal.

The present invention provides a sole for an athletic shoe including a sole plate and a plurality of openings that extend through the sole plate. A receptacle insert is embedded within the sole plate at each opening location and an inner sidewall of each receptacle insert defines a receiving opening for a cleat element. The receptacle insert does not require an increased sole plate. Each receiving opening has a plurality of engagement notches disposed around the periphery thereof. A plurality of detachable cleat elements each include a base member and a traction member. The base member has a plurality of engagement projections extending outward from its periphery. For attachment, each cleat element is positioned in one of the receiving openings such that the engagement projections are aligned with the engagement notches, and thus ensuring the proper orientation of the traction member. Rotation of the cleat element then detachably secures the cleat element within the receptacle insert of the sole plate. The present invention also provides a method for attaching and removing the cleat element to the shoe sole.

BRIEF DESCRIPTION OF THE DRAWINGS

The above description and other objects, advantages, and features of the present invention will be more fully understood and appreciated by reference to the specification and accompanying drawings, wherein.

DETAILED DESCRIPTION OF THE PREFERRED EMBODIMENTS

Figure 1:
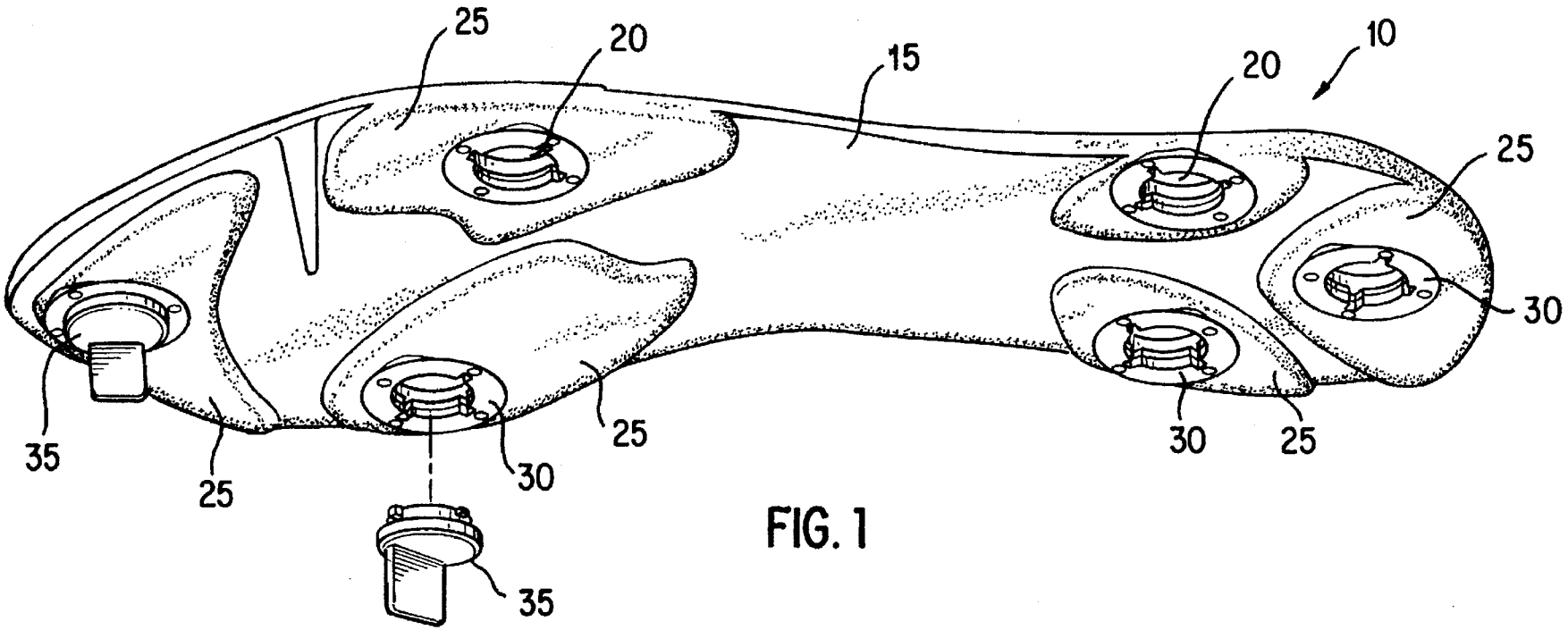
FIG. 1 is a bottom perspective view of a shoe sole according to the present invention.

A shoe sole in accordance with a preferred embodiment of the present invention is illustrated generally at 10 in FIG. 1. Shoe sole 10 is attached in a conventional manner, such as with an adhesive, to a shoe midsole and/or upper in order to form the finished article of footwear. Shoe sole 10 includes a generally planar surface 15 and a plurality of receiving openings 20 extending through sole 10. In a preferred embodiment of the invention, planar surface 15 has a raised ground engaging portion 25 surrounding each receiving opening 20. Shoe sole 10 also includes a receptacle insert 30 disposed within each opening and a detachable cleat element 35 that is detachably secured within each receptacle insert 30.

Figure 2:
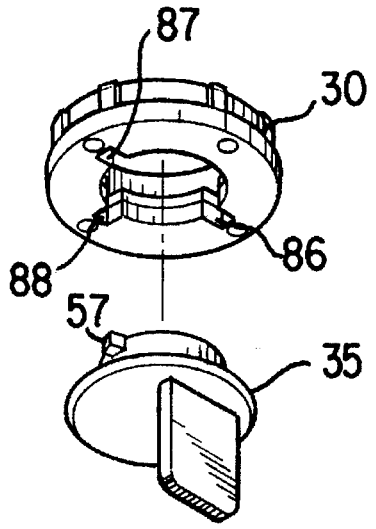
FIG. 2 is an exploded view of a receptacle insert and a detachable cleat element according to one embodiment of the present invention.
Figure 4:
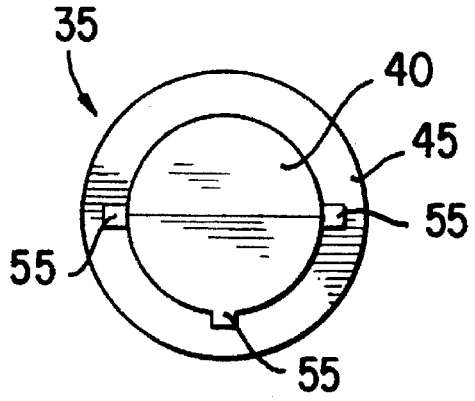
FIG. 4 is a top plan view of the detachable cleat element shown in FIG. 2.
Figure 5:
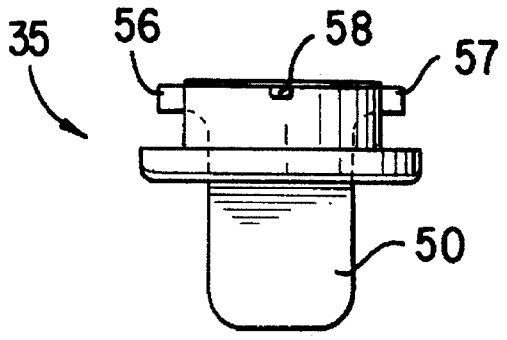
FIG. 5 is a front elevational view of the detachable cleat element shown in FIG. 2.
Figure 6:
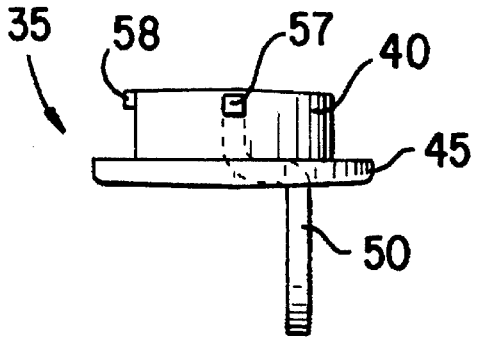
FIG. 6 is a side elevational view of the detachable cleat element shown in FIG. 2.

Referring to FIG. 2, an exploded view of receptacle insert 30 and a cleat element 35 according to one embodiment of the present invention is illustrated. As shown in detail in FIGS. 4–6, cleat element 35 includes a base member 40, a surface member 45 having a larger diameter than the base member, and a traction member 50 embedded within base member 40 and extending downwards from surface member 45. When correctly positioned in receptacle insert 30, surface member 45 is flush with the lower surface of receptacle insert 30 and traction member 50 extends downwards. Base member 40 and surface member 45 are preferably integrally molded from a hard and durable non-metallic material such as polyamides, nylon-6, nylon-11, nylon-12, PEBAX® of Elf Oltochem, Paris, France, polyurethane, other thermoplastic materials and the like. Traction member 50, a portion of which is preferably embedded within base member 40, can be either a metallic material such as high carbon steel, titanium, aircraft grade aluminum alloy such as "7075" made by Teledyne Wah Chang of Albany, Oreg., or a non-metallic material such as ceramic or a metal matrix composite such as an aluminum/ceramic made by Alcan International Ltd. of Kingston, Ontario, Canada. In accordance with the present invention, shorter traction members may be provided within a detachable cleat element for playing on synthetic turf or hard natural turn and longer traction members may be provided in a detachable cleat element for playing on natural turf. Different traction members could also be provided within the detachable cleats depending upon the particular sport, i.e., soccer, baseball, football, golf, and the like. Detachable cleat elements 35 can thus be interchanged on shoe sole 10, as described in detail below, depending upon the turf surface and the sports activity for which the article of footwear is utilized.

Figure 3:
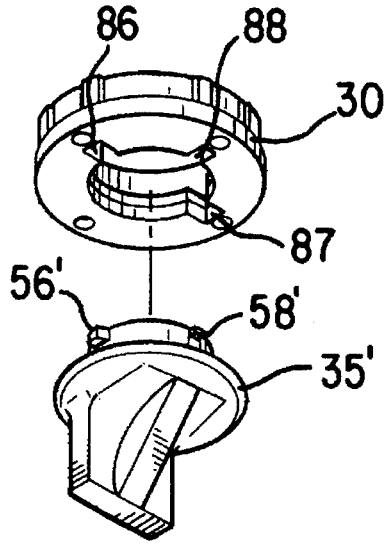
FIG. 3 is an exploded view of a receptacle insert and a detachable cleat element according to another embodiment of the present invention.
Figure 7:
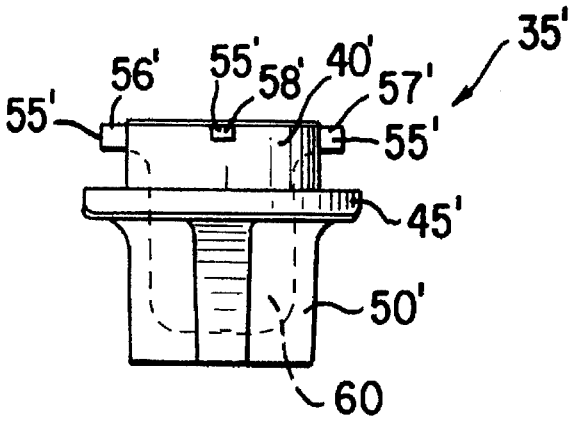
FIG. 7 is rear elevational view of the detachable cleat element shown in FIG. 3.
Figure 8:
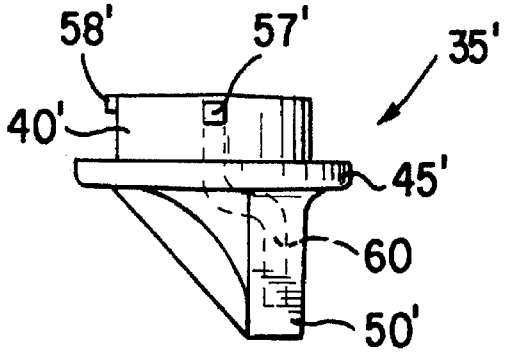
FIG. 8 is a side elevational view of the detachable cleat element shown in FIG. 3.
Figure 9:
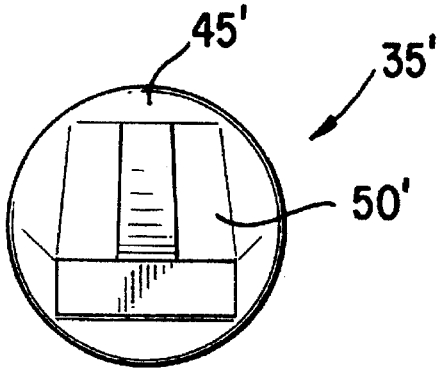
FIG. 9 is a bottom plan view of the detachable cleat element shown in FIG. 3.

Referring to FIG. 3, an exploded view of receptacle insert 30 and a cleat element 35' according to a further embodiment of the present invention is illustrated. As shown in detail in FIGS. 7–9, cleat element 35' includes a base member 40', a surface member 45' having a larger diameter than the base member, and a traction member 50' extending downwards from surface member 45'. When correctly positioned in receptacle insert 30, surface member 45' is flush with the lower surface of receptacle insert 30 and traction member 50' extends downwards. Base member 40', surface member 45', and traction member 50' are preferably integrally molded from a hard and durable non-metallic material such as polyamides, nylon-6, nylon-11, nylon-12, PEBAX® of Elf Oltochem, Paris, France, polyurethane, other thermoplastic materials and the like. Traction member 50' further includes an inner traction member core 60, a portion of which is preferably embedded within base member 40', which can be either a metallic material such as high carbon steel, titanium, aircraft grade aluminum alloy such as "7075" made by Teledyne Wah Chang of Albany, Oreg., or a non-metallic material such as ceramic or a metal matrix composite such as an aluminum/ceramic made by Alcan International Ltd. of Kingston, Ontario, Canada. As in the first embodiment described above, detachable cleat elements 35' can be interchanged on shoe sole 10, as described in detail below, depending upon the turf surface and the sports activity for which the shoe is utilized.

Cleat element 35, 35' also includes a plurality of engagement projections, generally shown by reference numeral 55, 55', projecting from the periphery of base member 40. In the preferred embodiments of the invention, two engagement projections 56, 56', 57, 57' extend through the interior of the base member and are integrally formed as extensions from traction member 50, or the inner traction member core 60 of traction member 50' and a third engagement projection 58, 58' is integrally formed as an extension of base member 40, 40'. As discussed in detail below, the use of engagement projections in connection with the notches of receptacle insert 30 yields the ability of cleat element 35, 35' to be detachably secured, always in the proper orientation, and changed according to the user's preference.

Figure 10:
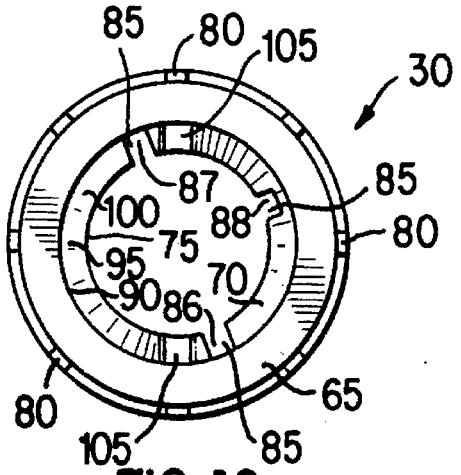
FIG. 10 is a top plan view of the receptacle insert shown in FIGS. 2 and 3.
Figure 11:
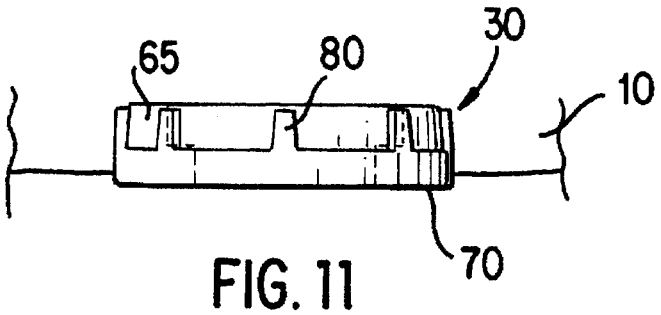
FIG. 11 is a side elevational view of the receptacle insert shown in FIGS. 2 and 3.
Figure 12:
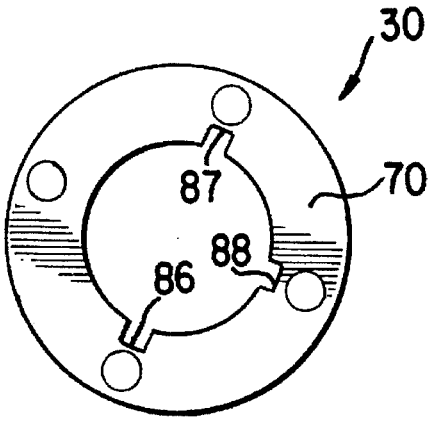
FIG. 12 is bottom plan view of the receptacle insert shown in FIGS. 2 and 3.

As shown in FIGS. 10–12, receptacle insert 30 is an annular ring having an upper portion 65, shown in FIG. 1, embedded within shoe sole 10 and a lower surface 70 that is generally flush with the ground engaging surface of the sole, such as raised ground engaging portions 25 in the present invention. In a preferred embodiment, the upper portion 65 of receptacle insert 30 has a plurality of spaced elements 80 around the periphery to assist in firmly securing insert 30 within the molded sole. Receptacle insert 30 includes a lower annular wall 75 having a first inner diameter and an upper annular wall 90 having a second larger inner diameter extending thereabove. An annular engagement surface 95 is thereby defined at the plane where the upper edge of wall 75 terminates and the lower edge of wall 90 begins. The inner diameter of the lower annular wall 75 of receptacle insert 30 defines the receiving openings 20 within the shoe sole 10. The inner wall 75 and engagement surface 95 also include a plurality of engagement notches generally shown by reference numeral 85, which are formed as cut away sections in the side wall 75. The specific position and spacing of engagement notches 86, 87, 88 generally correspond to that of engagement projections 56, 56', 57, 57', 58, 58', respectively. As discussed further below, the diameter of openings 20 generally also corresponds to the diameter of base member 40, 40' in order to enable the attachment of cleat elements 35, 35' to the sole.

Figure 13:
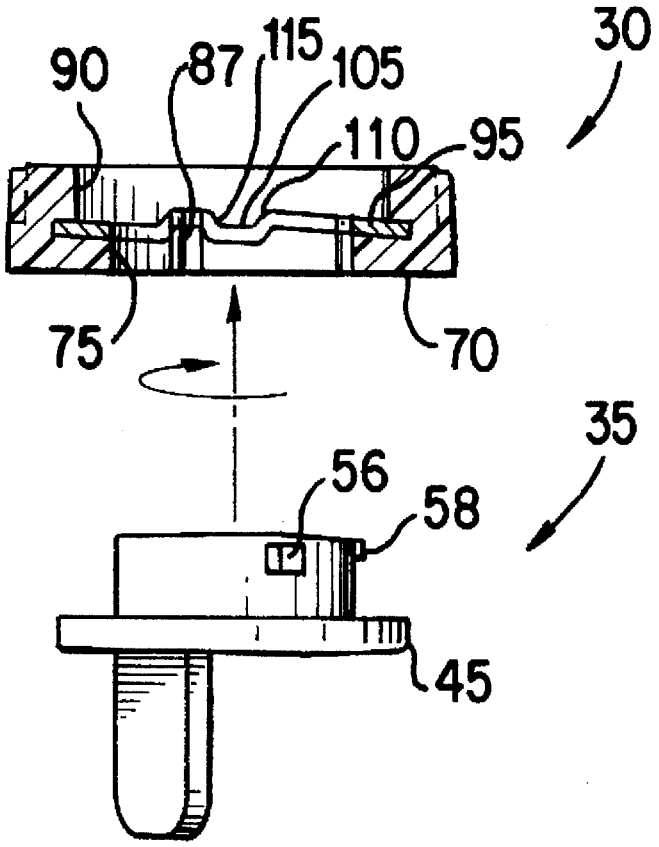
FIG. 13 is an exploded view illustrating the insertion of the detachable cleat into the receptacle insert and rotation of the detachable cleat.

Receptacle insert 30 is preferably molded from a hard plastic material such as polyamides, nylon-6, nylon-11, nylon-12, PEBAX® of Elf Oltochem, Paris, France, polyurethane, other thermoplastic materials and the like. In the illustrated embodiment of the present invention, a reinforcement layer 100 formed from a metallic or non-metallic material is also disposed directly above the annular engagement surface 95. Reinforcement layer 100 is preferably formed from high carbon steel. In addition to engagement notches 86, 87, 88 formed in engagement surface 95 and reinforcement layer 100, there is also a depression 105 adjacent to notch 86 and notch 87. Each expression 105 is formed between opposing angled wall surfaces 110, 115. As explained in detail below, these depressions serve to lock the engagement projections into position and to prevent accidental dislodgement during use. Finally, as most clearly shown in FIG. 13, engagement surface 95 slopes continually upwards from engagement notches 86, 87 to the opposing depression 105. This angled surface increases the friction between engagement projections 55, 55' and surface 95 as detachable cleat element 35 is rotated.

With reference to FIGS. 2, 3, 10 and 13, the method of attaching and removing cleat element 35, 35' to or from the shoe sole will now be described. Engagement projections 56, 57, 58 or 56', 57', 58' are aligned with engagement notches 86, 87, 88, respectively, such that cleat 35, 35' is thereby positioned for attachment to receptacle insert 30. Each engagement projection is inserted into the respective engagement notch until the surface member 45, 45' of cleat 35, 35' is flush with the lower surface 70 of receptacle insert 30, base member 40, 40' of cleat 35, 35' is completely disposed within receptacle insert 30, and engagement projections 55, 55' are above engagement surface 95. Cleat 35, 35' can only be inserted within receptacle insert 30 in one orientation.

Cleat 35, 35' is thereafter rotated, in a clockwise direction in the preferred embodiment illustrated, in order to rotate engagement projections 55, 55' out of alignment with each respective engagement notch 85. Cleat 35, 35' is rotated, with increasing force as necessary, in order to move engagement projections 55 up the sloping engagement surface 95. When cleat 35, 35' has been rotated approximately 150 degrees, projection 56, 56' moves into depression 105 adjacent to engagement notch 87 and projection 57, 57' moves into depression 105 adjacent to engagement notch 86. During this rotation, projection 58, 58' passes over one of the depressions 105. However, since projection 58, 58' is thinner than projections 56, 56' and 57, 57', it passes over depression 105 and is arrested by the sloping engagement surface 95. Thus, cleat element 35, 35' is locked into position and the proper orientation of the traction member is assured since the cleat element can only be inserted when properly aligned in a single position.

To remove cleat 35, 35' from the locked position, it may be rotated counter-clockwise. A counter-clockwise force applied to cleat 35, 35' in a sufficient degree will cause projections 56, 56', 57, 57' to move up the angled wall surface 110 of the respective depression 105. Thereafter, continued counter-clockwise rotation will cause the projections to move down the sloping engagement surface 95 until each engagement projection is again aligned with the respective engagement notch in the receptacle insert. Cleat element 35, 35' can then be simply removed from receptacle insert 30 and thus detached from sole 10.

It will be obvious to those of ordinary skill in the art that numerous modifications may be made without departing from the true spirit and scope of the present invention, which is to be limited only by the appended claims.

We claim:

1. A sole for an athletic shoe comprising:

a sole plate having an exterior surface and a plurality of openings through said sole plate;

a receptacle insert embedded within said sole plate at each said opening location, an inner sidewall of each said receptacle insert defining a receiving opening having a plurality of engagement notches around the periphery thereof; and a plurality of detachable cleat elements including a base member and a traction member extending from said base member, said base member having a plurality of engagement projections extending outward from a periphery thereof;

wherein each said cleat element is positioned in one of said receiving openings in a first position such that said engagement projections are aligned with said engagement notches and rotation of said cleat element to a second position detachably secures said cleat element within said receiving opening of said sole plate in a proper orientation.

wherein said receptacle insert further includes a depression adjacent to at least two of said engagement notches and a continuosly increasing engagement surface between said engagement notches and said depressions such that said engagement projections of said cleat element are subjected to a continuously increasing frictional resistance as said cleat element is rotated and said cleat element is securely locked into said second position.

2. The sole of claim 1 wherein said engagement projections of said cleat element correspond in size and number to said engagement notches of said annular receptacle insert.

3. The sole of claim 1 wherein said sole includes a plurality of raised ground engaging surfaces and each said receptacle insert is embedded with one of said raised ground engaging surfaces.

4. The sole of claim 1 wherein said traction member extends through said base member of said cleat to integrally form at least one of said engagement projections.

5. The sole of claim 4 wherein said traction member is integrally formed with two of said engagement projections extending outward from said base member.

6. The sole of claim 5 wherein said base member further includes a third said engagement projection integrally formed with said base member.

7. The sole of claim 1 wherein said receptacle insert includes an upper annular portion and a lower annular portion, an inner sidewall of said lower annular portion defining said receiving opening and said engagement notches extending vertically through said lower annular portion.

8. The sole of claim 7 wherein said engagement surface is defined at a plane where an upper edge of said lower annular portion terminates and from which said upper annular portion extends.

9. The sole of claim 8 wherein said engagement notches extend vertically through said engagement surface.

10. The sole of claim 1 wherein said cleat element is rotated approximatdy 150 degrees between said first position and said second position.

11. The sole of claim 10 wherein said lower annular portion further includes a reinforcing layer disposed above said engagement surface.

12. A method of attaching a traction member to a sole comprising the steps of:

aligning a plurality of engagement projections extending outward from a periphery of a detachable cleat with a plurality of engagement notches on a periphery of a receptacle insert in the sole;

inserting the detachable cleat into a receiving opening defined by the receptacle insert;

rotating the detachable cleat within the receptacle insert along a continuously upwardly inclined engagement surface;

locking the detachable cleat into a locked position within the receptacle insert by rotating the detachable cleat until at least one of the engagement projections is positioned in a corresponding locking depression in the receptacle insert.

13. The method of claim 12 wherein said rotating step includes applying an increasing rotation force to the detachable cleat as the engagement projections follow along said inclined engagement surface.

14. The method of claim 12 wherein said aligning step includes aligning three engagement projections on the detachable cleat with three engagement notches on the receptacle insert.

15. The method of claim 14 wherein said aligning step further includes assuring a proper orientation of the detachable cleat within the receptacle insert after said rotating and said locking steps.

* * * * *